US005603657A

United States Patent [19]

Sells

[11] Patent Number: 5,603,657

[45] Date of Patent: Feb. 18, 1997

[54] VENTILATING DEVICE

[75] Inventor: Gary L. Sells, Mishawaka, Ind.

[73] Assignee: Cor-A-Vent, Mishawaka, Ind.

[21] Appl. No.: 446,561

[22] Filed: May 19, 1995

Related U.S. Application Data

[63] Continuation-in-part of Ser. No. 269,916, Jun. 30, 1994.

[51] Int. Cl.[6] ..... F24F 7/02

[52] U.S. Cl. ..... 454/359; 454/365

[58] Field of Search ..... 454/358, 359, 454/360, 361, 363, 364, 365

[56] References Cited

U.S. PATENT DOCUMENTS

| | | | |
|---|---|---|---|
| 1,897,440 | 2/1933 | Richardson | 454/354 X |
| 3,403,616 | 10/1968 | Nelson | 454/354 X |
| 4,844,647 | 2/1990 | Garries et al. | 454/354 X |
| 5,080,005 | 1/1992 | Kolt | 454/359 |
| 5,092,225 | 3/1992 | Sells | 454/365 |
| 5,344,363 | 9/1994 | Pollock | 454/364 X |

FOREIGN PATENT DOCUMENTS

| | | | |
|---|---|---|---|
| 33523 | 3/1980 | Japan | 454/365 |

*Primary Examiner*—Harlod Joyce
*Attorney, Agent, or Firm*—Baker & Daniels

[57] ABSTRACT

A ventilating device covers an opening in a structure and includes longitudinally-extending compartments, each of the compartments having longitudinally-extending side walls. A baffle is placed in the compartments, and is otherwise unattached to the ventilating device. The baffle is movable from an inactive position permitting communication through the ventilating device to an active position closing off communication to thereby prevent wind-driven moisture from being driven into the ventilating device.

11 Claims, 12 Drawing Sheets

VENTILATING DEVICE

This is a continuation in part of U.S. Ser. No. 08/269,916, filed Jun. 30, 1994.

This invention relates to a ventilating device for ventilating the attic or upper floor of a structure.

Ventilating devices have been used to prevent dangerous heat buildup in the attics or upper floors of houses or other structures. Known types of ventilating devices include ridge vents, which extend along the ridge of the roof; gable vents, which are installed in the gable end surface of a structure; and roof ventilators, which are installed anywhere on the roof. Most types of the prior art ventilating devices make no provision to prevent entry of wind-driven rain or snow through the ventilating device. Accordingly, when sufficiently adverse weather conditions are present, wind-driven moisture can be forced into the attic or other area vented by the ventilating device. Other types of ventilators include hinged devices which are response to ambient wind conditions to close gable end vents. These hinged devices often fail.

The present invention provides a ventilating device in which a baffle is restrained only by the wall of a compartment, the walls having perforations to permit venting. During adverse weather conditions, the baffle is moved from an inactive position permitting venting through the perforations to an active position closing off the perforations to thereby prevent wind-driven moisture from entering the area ventilated by the ventilation device. The invention is applicable to ridge vent systems, gable end vents, and other types of roof venting systems placed on the roof surface.

These and other advantages of the present invention will become apparent from the following description, with reference to the accompanying drawings, in which.

Figure 11:
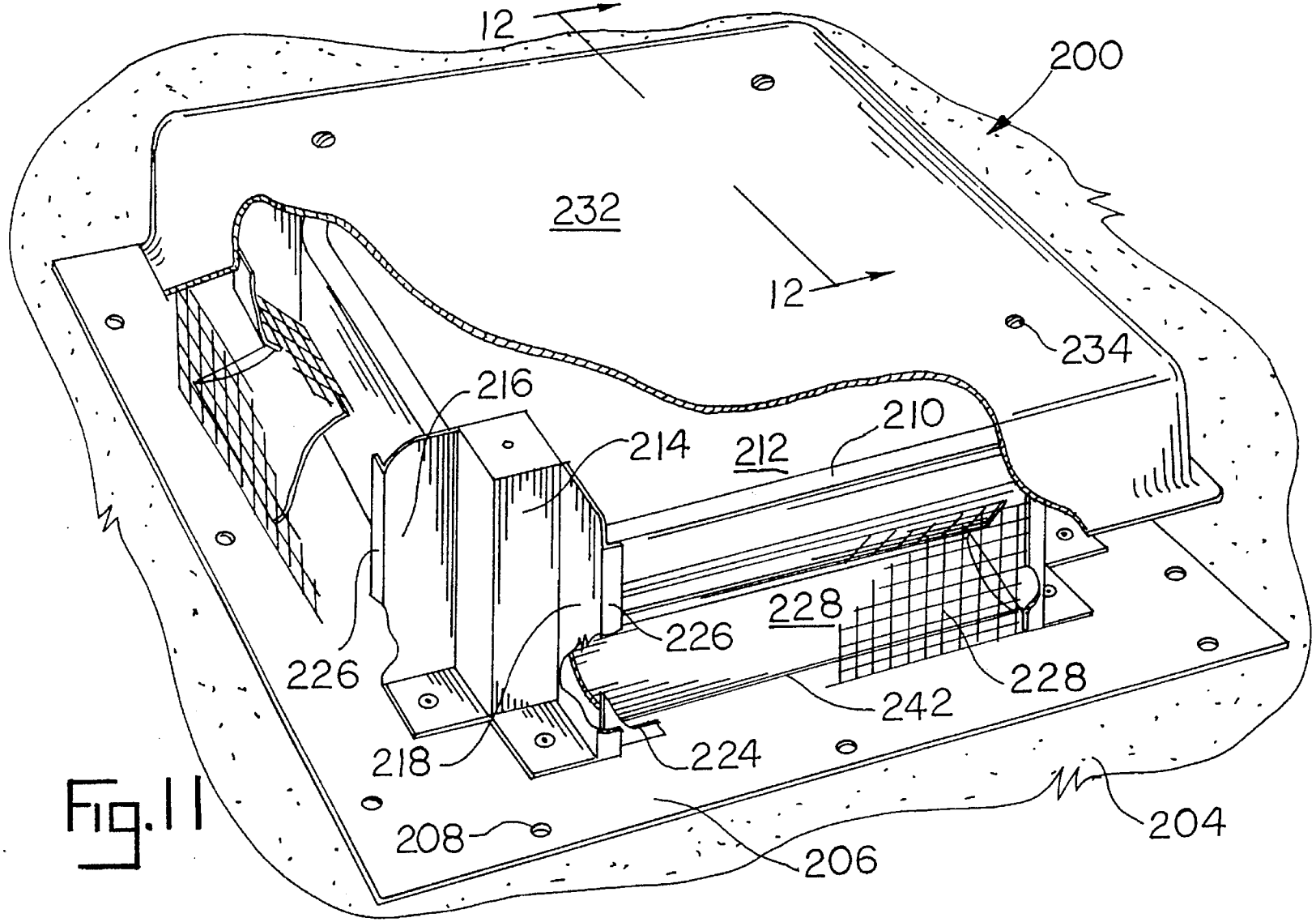
FIG. 11 is a fragmentary view in perspective, partly in section, of another form of rooftop ventilator made pursuant to the teachings of the present invention.
Figure 12:
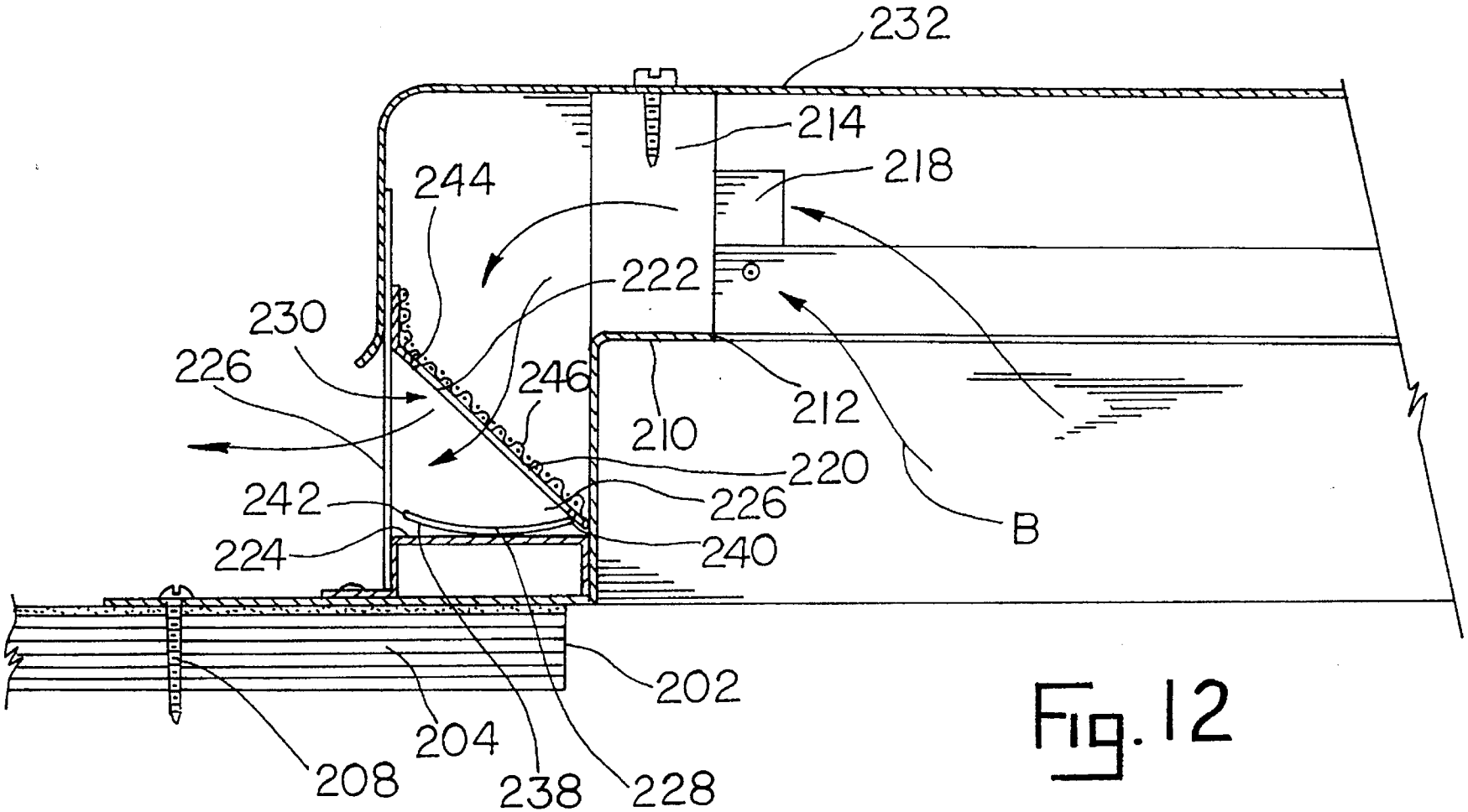
Figure 13:
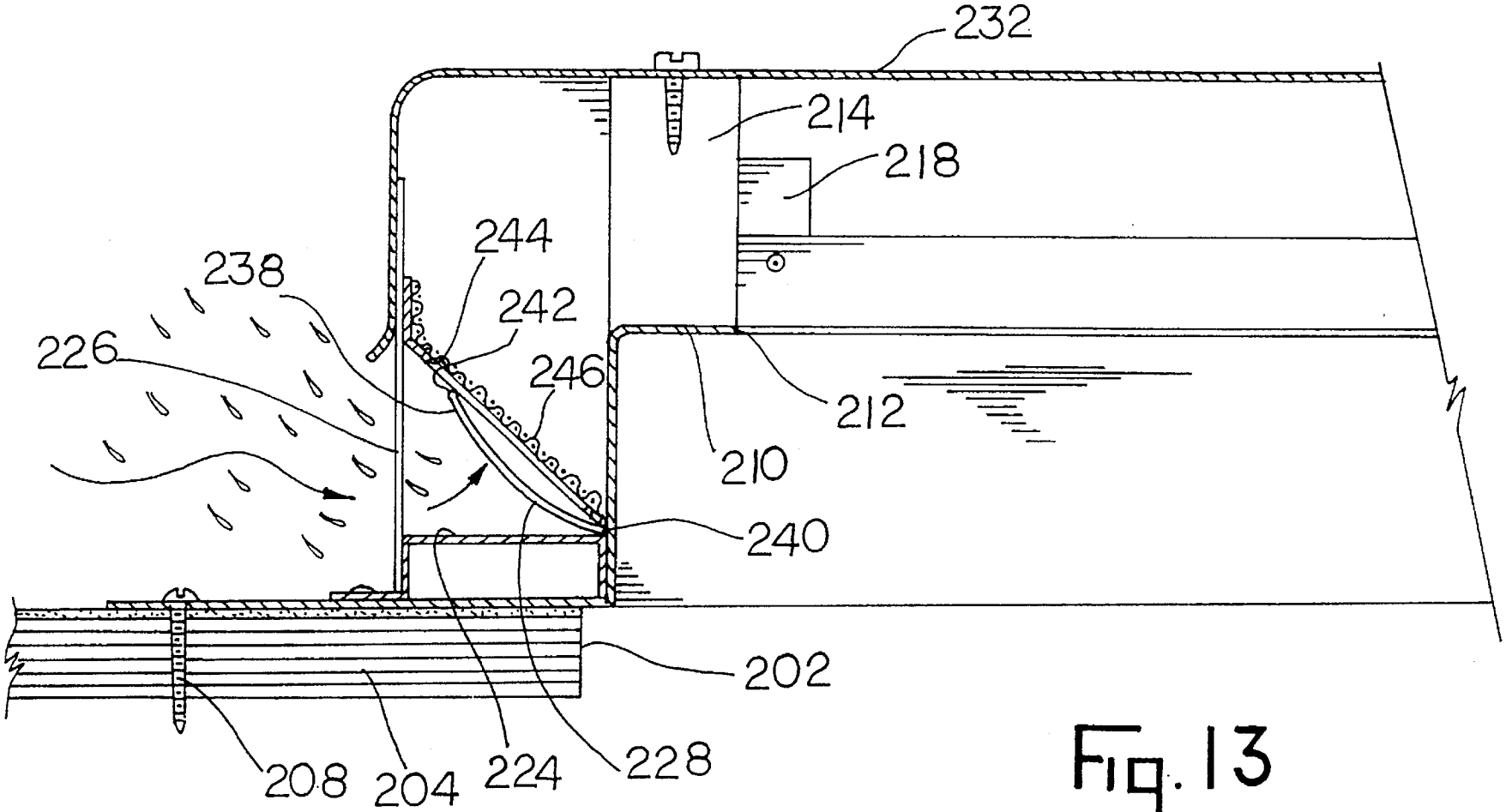

FIG. 12 is a fragmentary enlarged cross-sectional view taken substantially along lines 12—12 in FIG. 11 and illustrating the position of the baffle used in my invention during normal weather conditions to prevent venting through the device; and FIG. 13 is a view similar to FIG. 12 but illustrating the baffle in the closed or active position preventing entry of wind-driven moisture into the ventilating device.

Figure 1:
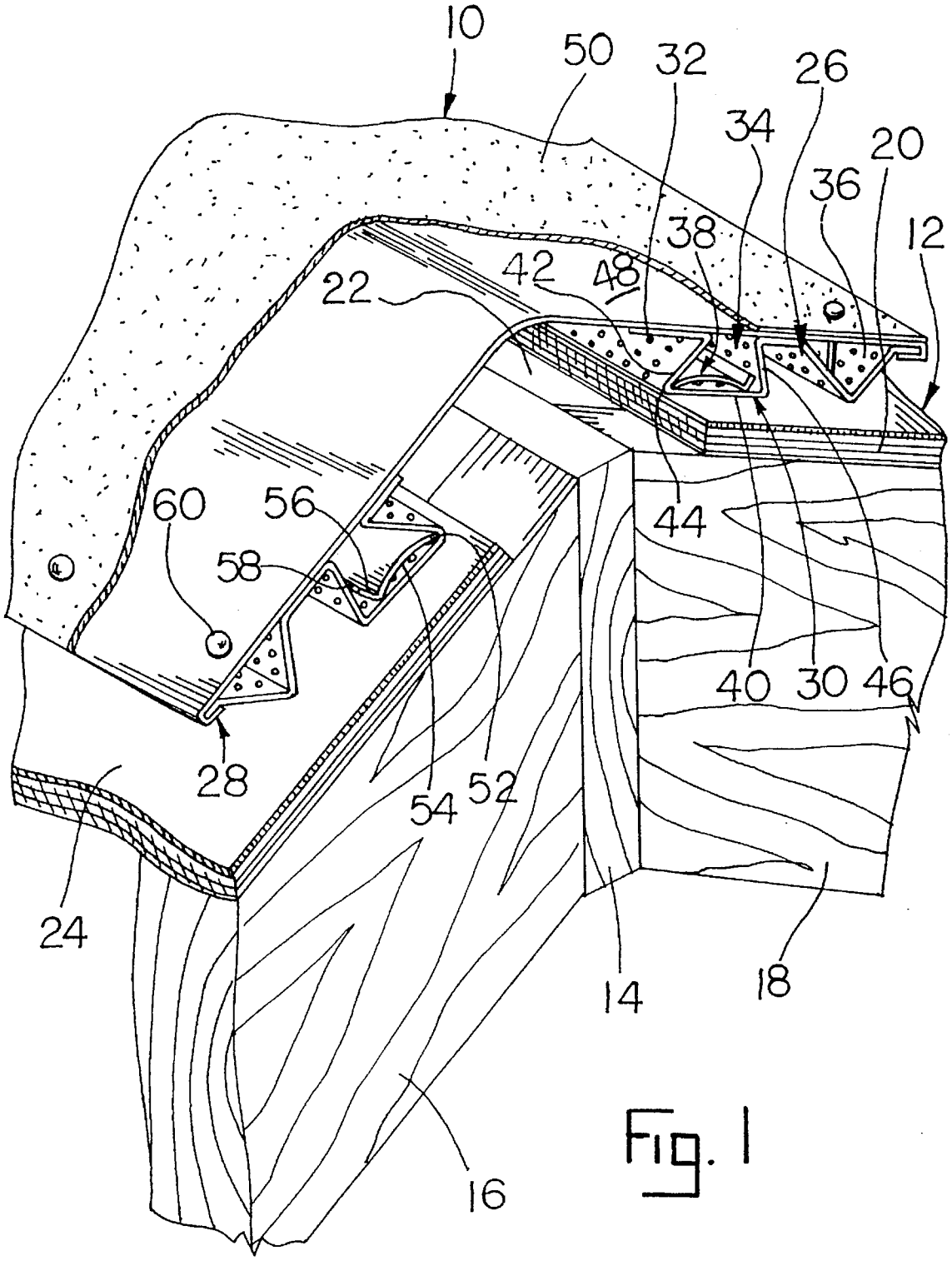
FIG. 1 is a fragmentary perspective view, partly in section, of a ventilating device made pursuant to the present invention applied over a vent opening in a roof.
Figure 2:
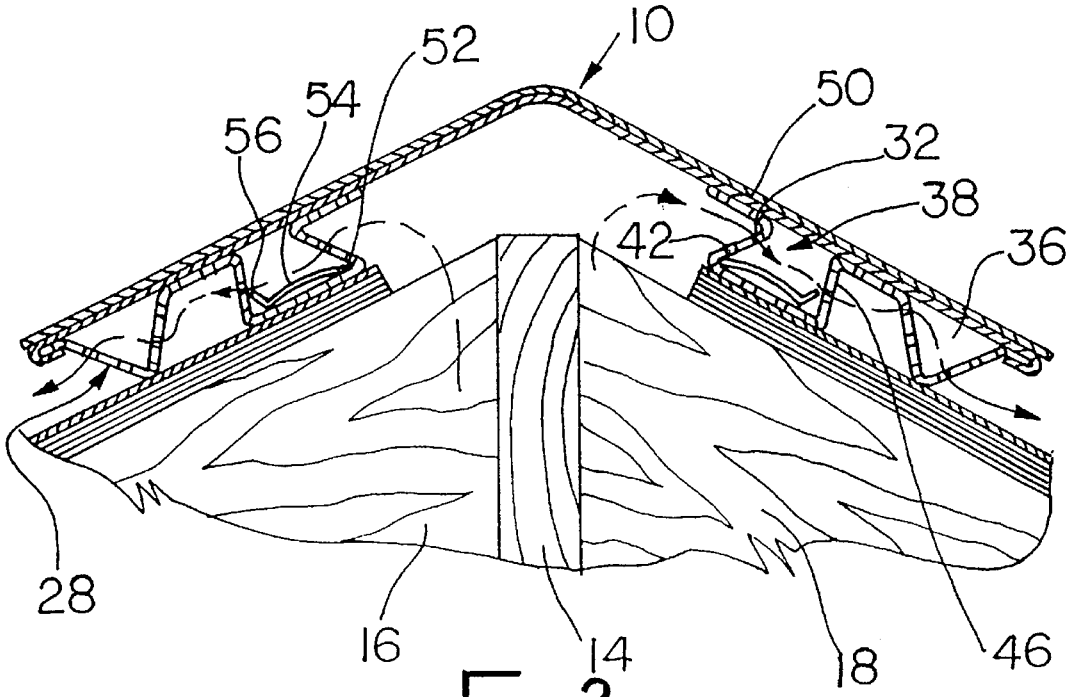
FIG. 2 is a fragmentary cross-sectional view taken through the ventilating device and the roof illustrated in FIG. 1, which illustrates the baffle of the present invention in the open or inactive position in which venting through the ventilating device is permitted.
Figure 3:
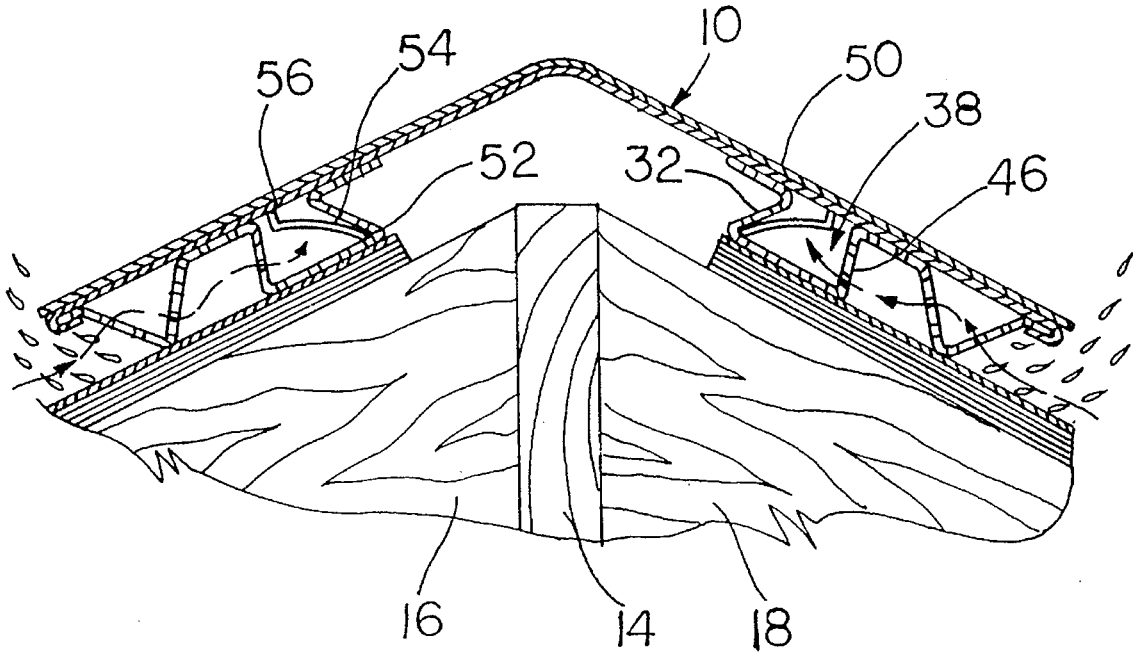
FIG. 3 is a view similar to FIG. 2, but illustrating the baffle according to the present invention in the closed or active position.

Referring now to the embodiment of FIGS. 1–3, a roof ventilating device generally indicated by the numeral 10 is mounted on the ridge of a roof generally indicated by the numeral 12. Roof 12 includes a longitudinally-extending ridge board 14 supported by transversely spaced inclined rafters 16, 18 in a manner well-known to those skilled in the art. The rafters 16 and 18 are covered by underlayment or sheeting 20. The portion of the sheeting adjacent to the ridge board 14 is cut away to define a vent opening 22. The vent opening 22 extends longitudinally along both sides of the ridge board 14. Shingles 24 are applied to the sheeting 20.

Referring now to the ventilating device 10, a pair of vent supports 26, 28 are applied adjacent to the vent opening 22 and extend longitudinally therealong substantially parallel to the ridge board 14. Each of the supports 26, 28 includes a sheet 30 of sheet metal which is perforated as indicated at 32. Each sheet 30 is folded as indicated to define compartments 34, 36. A longitudinally extending baffle 38 is installed in each of compartments 34 and extends longitudinally therein for an indefinite length. Compartment 34 is defined by a bottom edge 40 and a side edge 42 which tapers toward bottom edge 40 to form an acute angle therewith to define a pocket 44. The compartment is also defined by side edge 46 opposite the edge 44 and by a metallic or plastic upper cap member 48 which bridges the vent opening 22. Singles 50 are applied to the cap member 48.

The baffles 38 are defined by a longitudinally-extending edge 52 which is received within the pocket 44 formed by the edges 40 and 42. The baffle 38 is contoured to define a pressure-responsive surface 54 against which wind pressure acts to drive the baffle from the open or inactive position illustrated in FIGS. 1 and 2 to the active or closed position illustrated in FIG. 3 in response to wind in excess of a predetermined wind speed. An upwardly-extending lip 56 extends from pressure-responsive surface 54 and acts as a "scoop" to catch the wind to thereby pivot the baffle about the edge 52 for a small distance to allow wind access to the pressure-responsive surface 54. It will noted that since the edge 52 is substantially constrained by the pocket 44 formed by the sides 40 and 42, the baffle 54 will pivot about the edge 52 as it moves from its open or inactive position to the closed or active position. The lip 56 terminates in an edge 58 opposite the edge 52 which, as illustrated in FIG. 3, engages the cap 48 when the baffle is in the active position which prevents wind-driven moisture from being driven through the ventilation device 10 and into the vent opening 22. When wind conditions subside, the baffle drops back to the inactive position illustrated in FIG. 1 and 2.

Clearly, it is necessary that the baffle be consistently returned to the inactive position when wind conditions subside. Accordingly, the baffle cannot be permitted to cock within the compartment. Accordingly, it is necessary that the pocket 44 formed by the sides 40 and 42 restrain the edge 52 of the baffle, and that the ratio of the width of the compartment 34 to the height thereof be in the ratio of three units to two units. The width of the baffle is generally slightly less than the width of the compartment. Accordingly, the baffle can move easily within the compartment between the inactive and the active position, but cocking and tilting of the baffle is prevented, and the baffle cannot be moved into a position such that gravity cannot return it to the inactive position. The ventilation device 10 is held on the roof by roofing nails 60 which are driven through compartments 36. It is necessary for the installer to take particular care that the nails 60 are not inadvertently driven through the compartment 34 where the nails will interfere with the baffle.

Figures 4A, 4B, 4C, 4D:
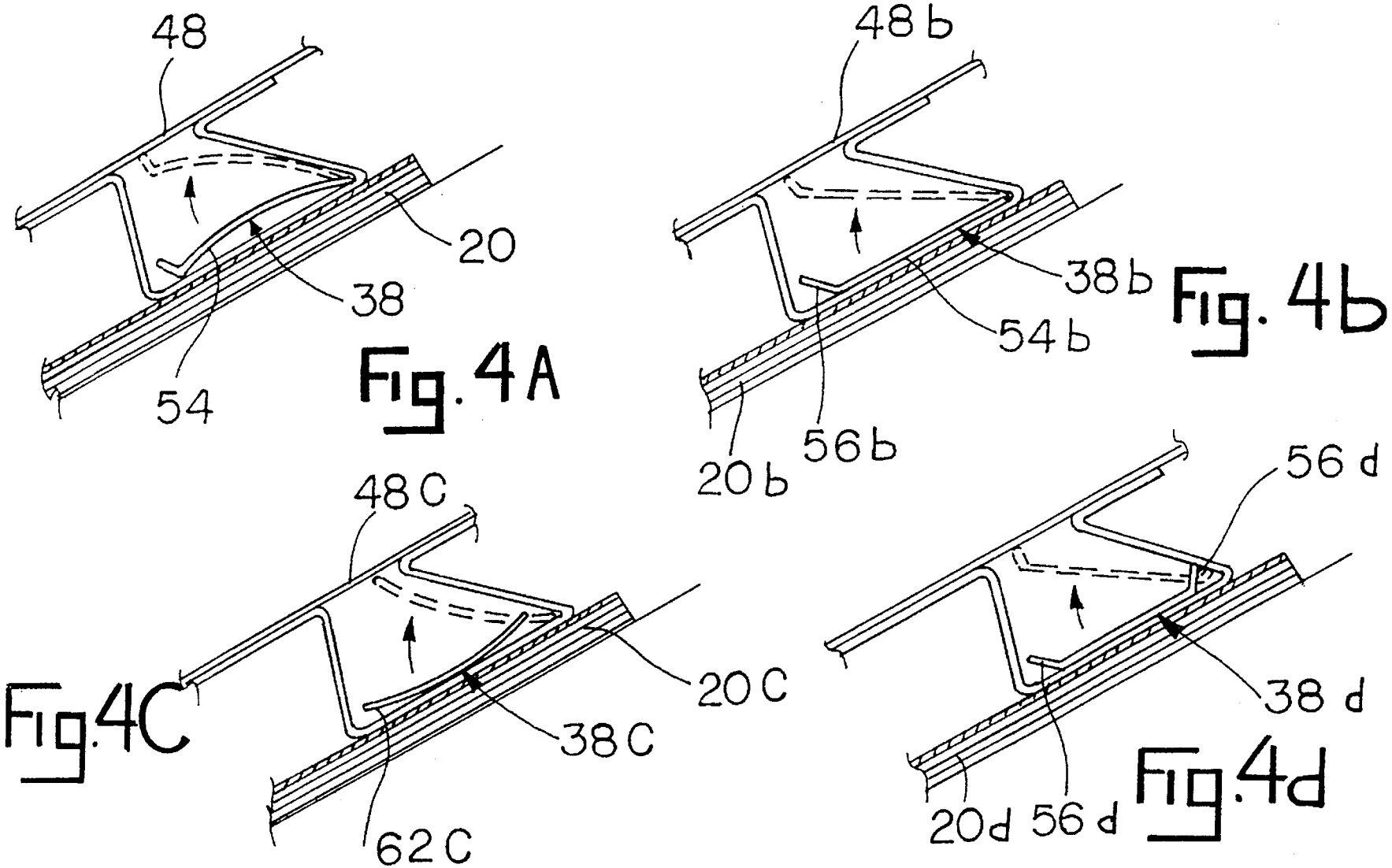
FIGS. 4A–4D are fragmentary cross-sectional views of a portion of the ventilator illustrated in FIGS. 1–3 and illustrating various embodiments of the baffle used therein to close off venting during adverse weather conditions.

Referring to FIGS. 4A–4D, multiple shapes of the baffle 38 are possible. In FIG. 4A, the baffle 38 is the same as the baffle 38 in FIGS. 1–3. It will be noted that the pressure-responsive surface 54 is a curved air-flow surface. In FIG. 4B, the surface 54C is substantially flat, and the baffle 38 depends entirely upon the scooping effect of the lip 56C for actuation. In FIG. 4C, common venetian "mini-blind" stock is used for the baffle. Accordingly, since the mini-blind stock is readily available, baffles 38 as shown in FIG. 4C are inexpensive, and if properly installed, the forward edge 62 acts as a scoop to permit the baffle to "catch" the wind and move to the actuated position as illustrated. In FIG. 4D, a baffle 38 similar to that illustrated in FIG. 4B is used, however, lips 56D are used on both ends of the baffle, thereby preventing the baffle from being installed backward. If the baffle in FIG. 4D is revised, the baffle does not function properly.

Figure 5:
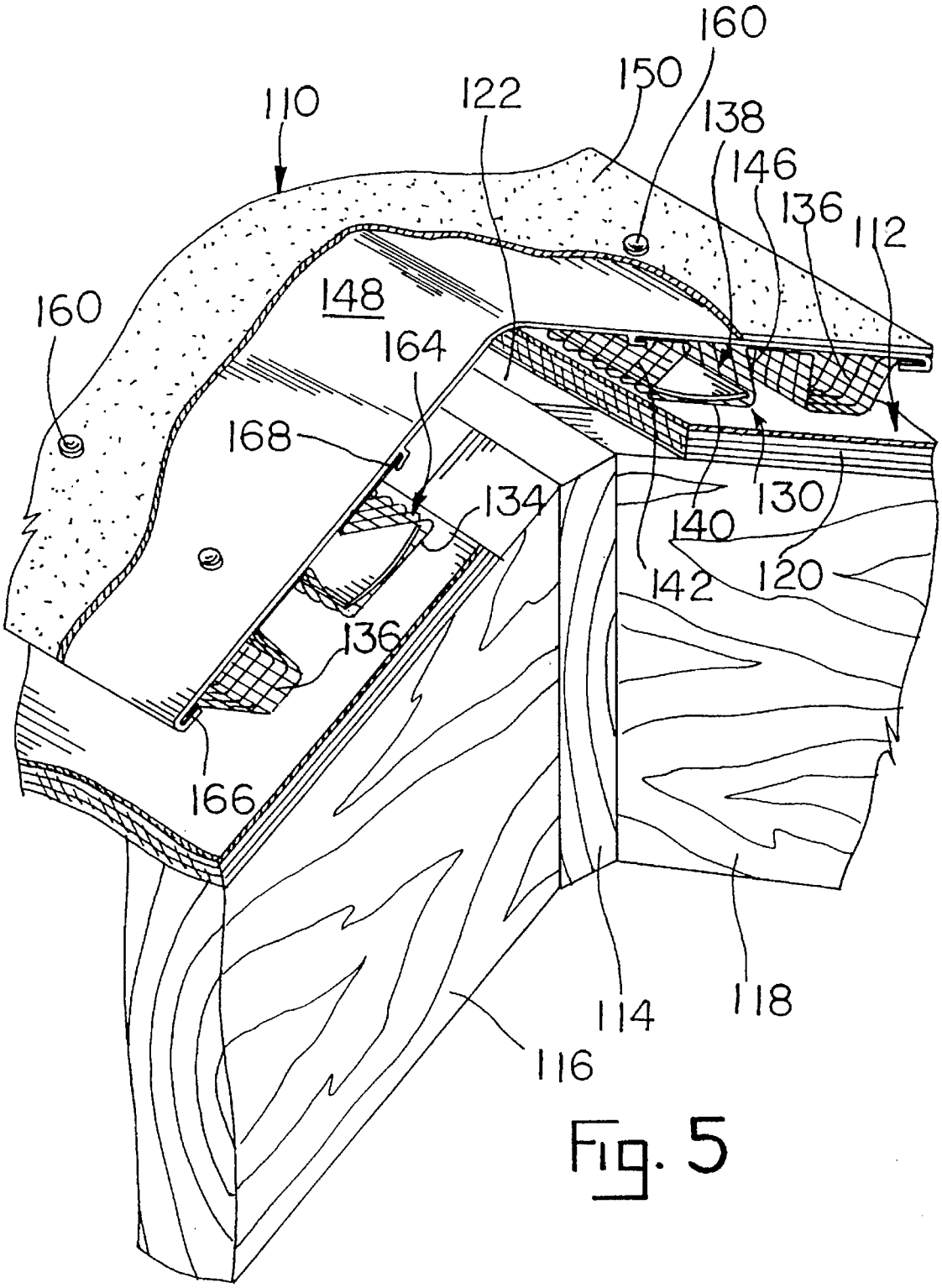
FIGS. 5, 6 and 7 are views similar to FIGS. 1, 2 and 3 respectively, but illustrating an alternate embodiment of the present invention.
Figure 6:
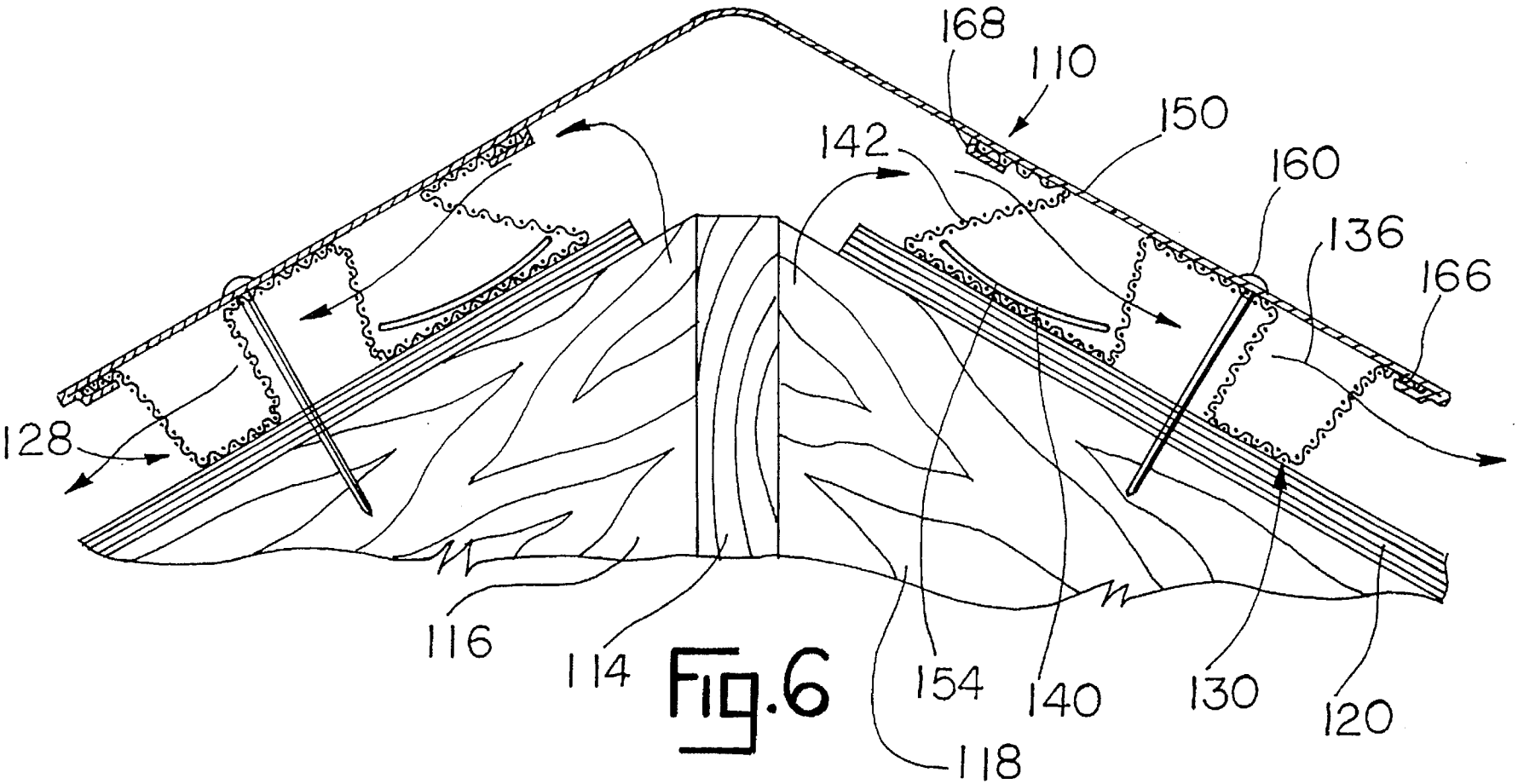
Figure 7:
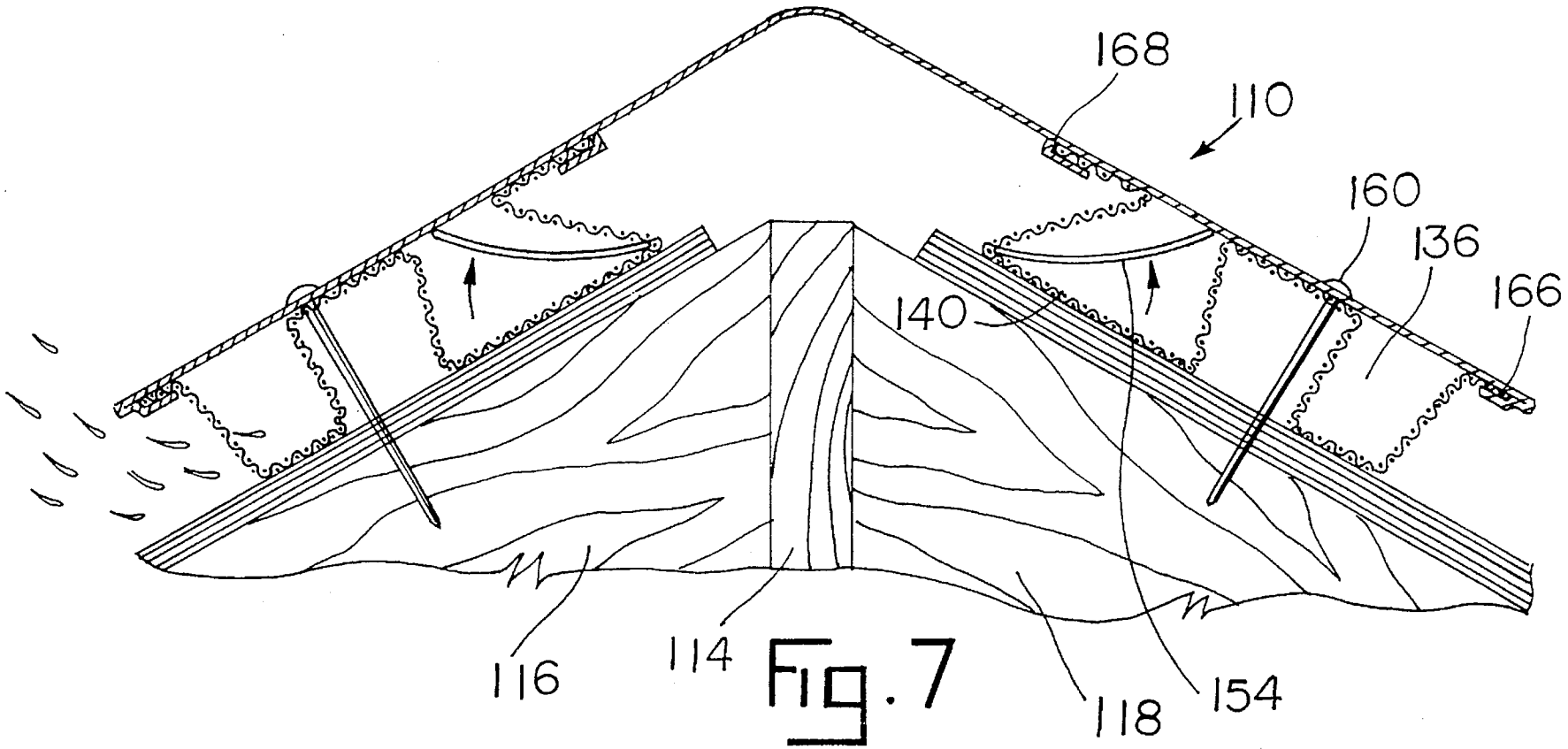

Referring now to the embodiment of FIGS. 5–7, elements of the same or substantially the same as those of the embodiment of FIGS. 103 retain the same reference numeral, but increase by 100. In FIGS. 5–7, the sheet 30 is replaced by a bent screen wire 164. Screen wire 164 is inexpensive, and can be formed easily into the compartments 134, 136. Grooves 166, 168 are formed on the underside of the cap 148 and receive opposite edges of the formed wire screen 164 to secure them to the cap member 148. The grooves extend longitudinally parallel to the vent openings 122 for substantially the entire length of the ventilating device 110.

Figure 8:
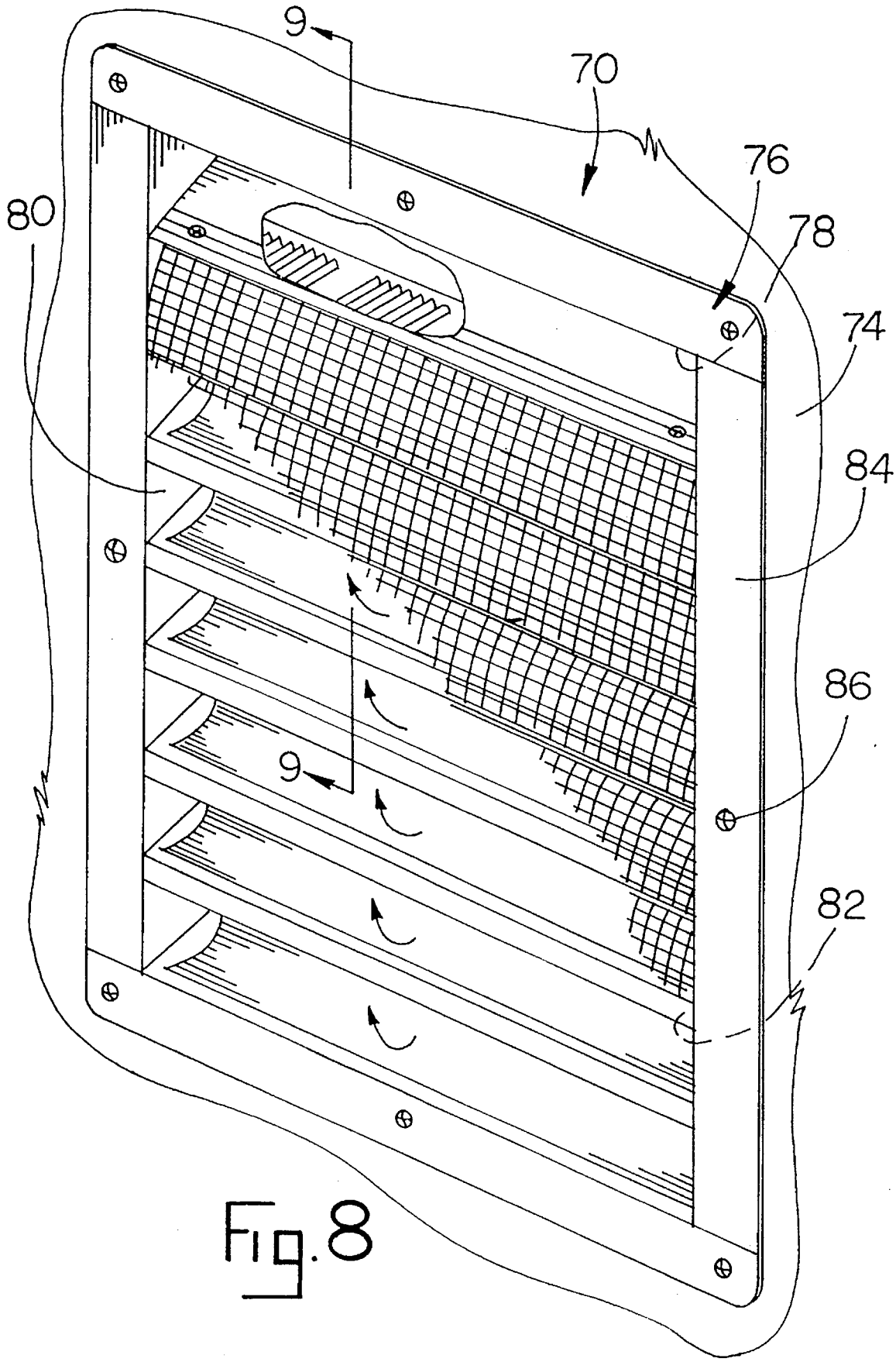
FIG. 8 is a fragmentary view in perspective of a gable end vent made pursuant to the teachings of the present invention in which a portion of the outer mesh covering has been broken away to illustrate the detail of the baffle used to close off the ventilating device during adverse weather conditions.
Figure 9:
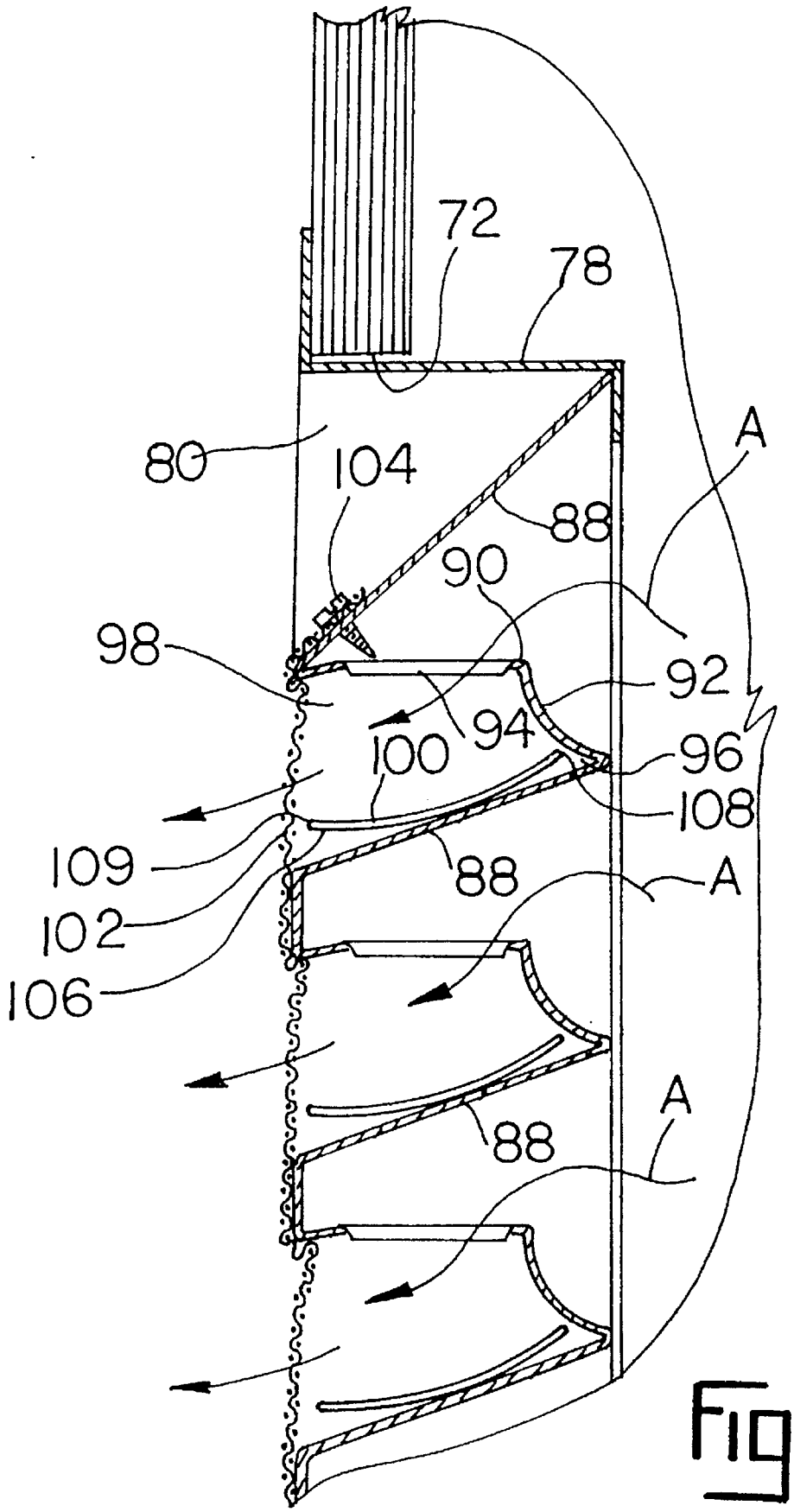
FIG. 9 is a fragmentary cross-sectional view taken substantially along lines 9—9 of FIG. 8, and illustrating the baffle used in the ventilating device in the open or inactive position permitting ventilating through the device.
Figure 10:
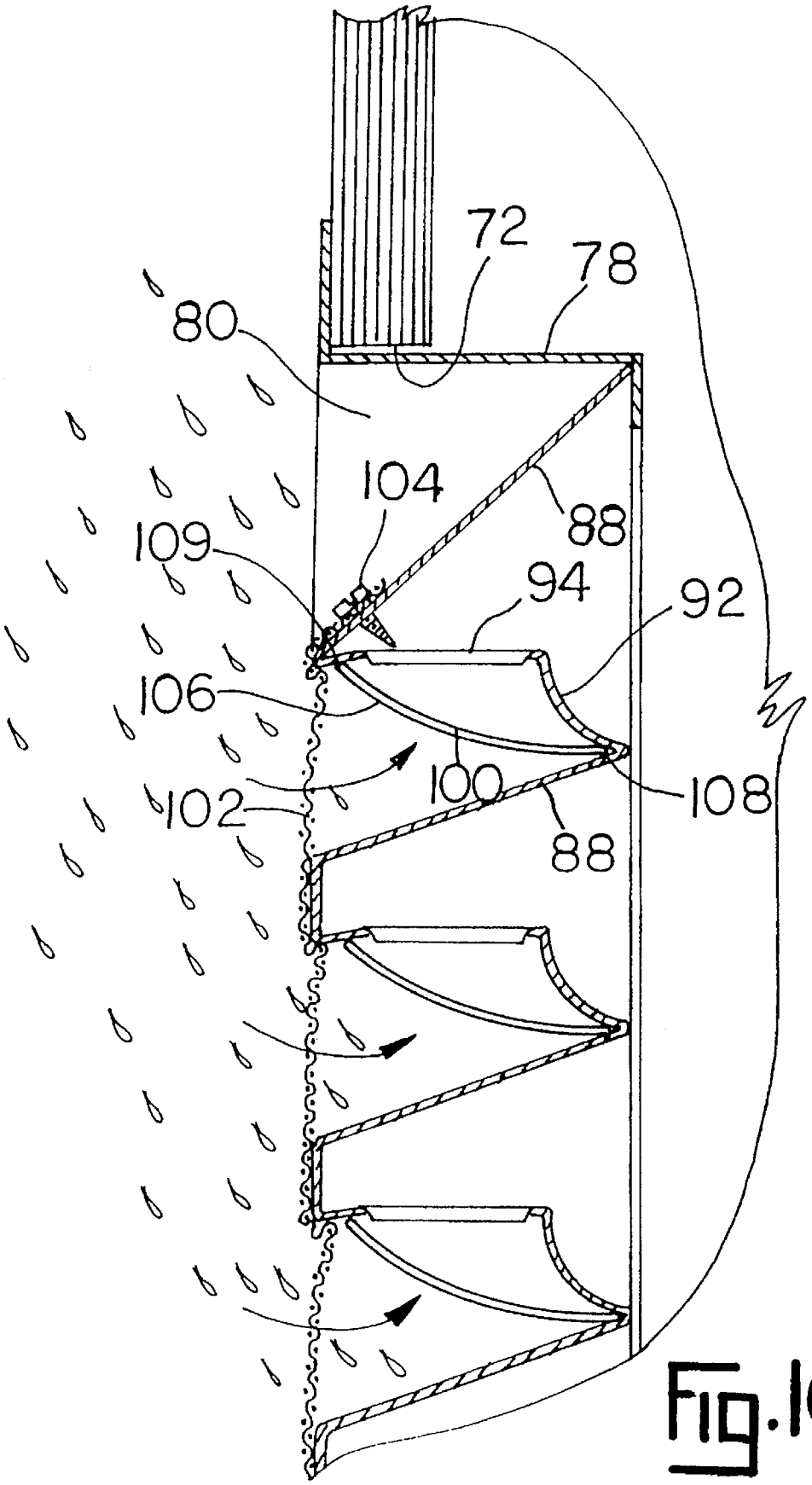
FIG. 10 is a view similar to FIG. 9 but illustrating the baffle in the closed position to prevent entry of wind-driven moisture during adverse weather conditions.

Referring now to FIGS. 8–10, a gable end venting device generally indicated by the numeral 70 is secured in an aperture 72 cut in the gable end 74 of a structure to be ventilated. The gable end vent 70 includes a frame 76 consisting of upper frame member 78, a lower frame member (not shown), and side frame members 80 and 82. A mounting flange 84 extends around the upper, lower and side frame members and is apertured to receive fasteners 86 to attach the ventilating device 70 to the structure. Angled frame members 88 extend between the side members 78 and 80 and angle downwardly viewing the Figure from the rear of the frame 76 to the front of the frame 76. Each of the angled members 88 are connected by frame members consisting of substantially horizontal sections 90 and curved sections 92. Louvers 94 are provided in the sections 90 and cooperate with angled portions 88 to define a pocket 96. Accordingly, the angled portions 88, the curved portions 92, and the horizontal portions 90 cooperate to form a compartment 98 which receives a baffle 100 which extends longitudinally between the side frame members 80 and 82. Each compartment is closed by a wire mesh screen 102 which extends along the front face of the gable end vent 70 and is secured to the top angle member 88 and bottom angle member 88 by sheet metal screws 104. Each of the baffles 100 have a curved cross-section define a pressure-responsive surface 106 which responds to ambient wind conditions to move from the inactive position illustrated in FIG. 9 in which the baffles 100 rest against angled portions 88 to permit venting through the gable end vent 70 through the louvers 94 and wire mesh screen 102 as indicated by the arrows A in FIG. 9 to the active or closed positions illustrated in FIG. 10. In this condition, the longitudinally-extending edge 108 of each of the baffles 100 is received in the pocket 96, and the forward edge 110 of each baffle 100 engages a portion of the horizontal surface 90 just forward of the louvers 94, to thereby prevent wind-driven moisture from entering the structure through the louvers 94. Since the rear edge 108 is received in pocket 96, the baffle 100 is prevented from cocking or otherwise being displaced so that the baffle 100 is returned to the inactive position illustrated in FIG. 9 by the force of gravity. The width of the baffles 100 between the edges 108 and 110 and the height of the compartment 98 is sufficiently small that the baffles 100 are restrained in their movement and cannot be displaced to an inoperative position.

Referring now to the embodiment of FIGS. 11–13, a roof ventilating device generally indicated by the numeral 200 covers an aperture 202 cut in the roof 204 of a structure for the purpose of ventilating the attic or upper floor thereof. The roof ventilator 200 includes a flange 206 which extends perimetrically around the device 200 and is secured to the margin of the roof defining the aperture 202 by screw fasteners 208. The flange 206 terminates in a raised portion 210 defining an opening 212 over the aperture 202. At each corner of the raised portion 210 column supports 214 extend upwardly from the flange 206 and extend above the level of the raised portion 210. Outwardly projecting flanges 216, 218 extend from each of the columns 214 and extend parallel to each side of the ventilating device 200. Angled plates 220 extend between the flanges 216, 218 of adjacent column supports 214 and are provided with a substantial rectangular aperture 222 that extends for almost the entire length of support plate 220. A lower support plate 224 also extends between flanges 218, 216 of adjacent column supports 214 and joins with its corresponding angle plate 220 to define an apex or a pocket 226 therebetween. A baffle 228 is placed in the compartment 230 defined by the plates 220, 224 and is retained therein by flanges 226 that extend from the flanges 216, 218. When necessary, a wire mesh screen 228 can also be provided to retain the baffle 228 in the compartment 230. A cover or cap 232 covers the entire raised portions 210 of the columnar supports 214 and the flanges 216, 218 and 226 and is secured to the top of the columnar 214 by screws 234 received in aperture 236 provide the top of each column 214. During normal conditions when venting takes place, the baffle 228 rests on the plate 224, to permit substantially unrestrained venting through the aperture 202 as indicated by the arrow B in FIG. 12. However, when atmospheric wind conditions exceed a predetermined level, the atmospheric wind impinging on the surface 238 of baffle 228 urges the baffle toward the active position illustrated in FIG. 13. In this position, the rear longitudinally-extending edge 240 is received in the pocket 226 defined at the convergence between the plates 224 and 222, whereby the baffle is restrained against cocking motion to permit the baffle to be returned to the inactive position of FIG. 12 by the force of gravity. At the same time, the forward longitudinally-extending edge 242 engages against the portion 244 of the plate 220 which supports wire mesh screen 246 over the aperture 222 to thereby prevent entry of wind-driven moisture into the ventilating device 210. It will be noted that the height of the compartment 230 is less than the width of the baffle 228 to permit the baffle to close against the surface 244 and yet be restrained by the pockets 240 such that the baffle will be automatically returned to the inactive position when the adverse conditions are no longer present.

I claim:

1. A ventilating device for a structure having a vent opening, said ventilating device including a cover for said vent opening, said cover including means for defining longitudinally extending compartments, each of said compartments having longitudinally extending side walls, at least some of said side walls having perforations defining vent passages communicating said vent opening with ambient atmosphere, and a deflectable baffle in one of said compartments movable from an inactive position permitting communication through said passages to an active position closing said passages to prevent entry of wind driven moisture into said passages, said baffle including a pressure responsive surface responsive to atmospheric wind to move said baffle from said inactive position opening said passages to said active position closing said passages in response to wind in excess of a predetermined ambient with speed, said baffle being an elongated strip of imperforate material restrained by the walls of said compartment and being unattached to the walls of said compartment.

2. Ventilating device as claimed in claim 1, wherein said structure includes a roof having ridge, said vent opening extending longitudinally along said ridge, said compartments extending longitudinally along said vent opening.

3. Ventilating device as claimed in claim 2, wherein said side walls are formed of wire mesh screen bent into sections defining said compartments, said cover including a longitudinally extending cap covering said compartments, said cap including longitudinally extending slots, said wire mesh screen having opposite ends received in said slots.

4. Ventilating device as claimed in claim 1, wherein said structure includes a gable end wall, said vent opening being defined in said gable end wall, said compartments extending longitudinally across said opening.

5. Ventilating device as claimed in claim 1, wherein said structure includes a roof, said vent opening being defined in said roof by edge portions circumscribing said vent opening, said cover including support portions secured to said edge portions and supporting a closing member extending over the vent opening, said compartments extending longitudinally across said opening.

6. Ventilating device as claimed in claim 1, wherein said means for defining said compartments includes wire mesh screen defining said passages.

7. Ventilating device as claimed in claim 1, wherein said baffle has a pair of opposite longitudinally extending edges, each of said compartments having a pair of said side walls which taper to an apex receiving one of said edges of said baffle to thereby constrain said baffle for movement between said open and closed positions.

8. Ventilating device as claimed in claim 7, wherein each of said compartments includes an upper wall and a lower wall opposite said upper wall, said lower wall defining one of said pair of side walls, said baffle being supported on said lower wall when the baffle is in the open position, the other edge engaging said upper wall when the baffle is in the active position.

9. Ventilating device as claimed in claim 8, wherein the width of the baffle between said edges and the distance between the upper and lower walls is in the ratio of three units to two units.

10. Ventilating device as claimed in claim 8, wherein the cross section of said baffle between said longitudinally extending edges is contoured to scoop ambient wind to cause the latter to force the baffle from the inactive to the active position when ambient wind speed exceeds said predetermined wind speed.

11. Ventilating device as claimed in claim 8, wherein said upper wall and said apex restrain movement of said baffle such that said baffle is returned to said inactive position by gravity.

* * * * *